US005681619A

United States Patent [19]

Ogasawara

[11] Patent Number: 5,681,619

[45] Date of Patent: Oct. 28, 1997

[54] METHOD FOR COATING IN PLURAL COATING LINES AND DRYING IN A SINGLE MAIN DRYING OVEN

[75] Inventor: Toshifumi Ogasawara, Hiroshima-ken, Japan

[73] Assignee: Mazda Motor Corporation, Hiroshima-ken, Japan

[21] Appl. No.: 696,565

[22] Filed: May 8, 1991

[30] Foreign Application Priority Data

May 8, 1990 [JP] Japan ..... 2-119615
Apr. 26, 1991 [JP] Japan ..... 3-125114

[51] Int. Cl.[6] ..... B05D 3/02

[52] U.S. Cl. ..... 427/379; 118/66; 118/67

[58] Field of Search ..... 427/379, 372.2; 118/67, 66

[56] References Cited

U.S. PATENT DOCUMENTS 3,902,453 9/1975 Frische ..... 118/66
4,667,621 5/1987 Kusunoki et al. ..... 118/326
4,988,537 1/1991 Tanimoto et al. ..... 427/379

FOREIGN PATENT DOCUMENTS 58-223458 12/1983 Japan .
61-143684 7/1986 Japan .
62-268645 11/1987 Japan .

*Primary Examiner*—Katherine A. Bareford
*Attorney, Agent, or Firm*—Morrison & Foerster LLP

[57] ABSTRACT

Only one common main drying oven is provided for plural coating lines. Each of the plural coating lines contains a coating zone and a preparatory drying oven, in which the coating zone is to coat work with a paint and the preparatory drying oven is to perform preparatory drying of the coat on the work prior to the main drying of the coat on the work in the main drying oven. A drying line is further disposed individually and independently from the plural coating lines so as to be applicable as a supply line for supplying the work to the plural coating lines for coating. The plural coating lines are connected to each other through a common line and the work is transferred between the drying line and the common line through transfer units.

10 Claims, 5 Drawing Sheets

METHOD FOR COATING IN PLURAL COATING LINES AND DRYING IN A SINGLE MAIN DRYING OVEN

BACKGROUND OF THE INVENTION

1. Field of the Invention

The present invention relates to a coating method and a coating apparatus therefor.

2. Description of Related Art

The machinery of coating work with a paint, e.g. a coating line for coating automotive vehicle bodies with the paint, is provided with a series of equipment ranging from coating the work with the paint to drying the coat on the work. More specifically, one coating line has at least a coating zone for coating the work with the paint, a setting zone for causing volatile components in the paint to evaporate from the coat on the work at temperatures, for example, as low as room temperature, and a drying oven for baking the coat on the work after passage of the work through the setting zone.

When the coat is dried by the drying oven, the temperatures are raised gradually to a predetermined temperature range over a considerably long period of time in order to prevent pinholes from occurring due to rapid evaporation of the volatile components from the coat, and the coat is continued to be baked at a set temperature for a predetermined period of time, e.g. as high as approximately 140° C.

Japanese Patent Laid-open Publication (kokai) No. 143, 684/1986 discloses technology in which the drying oven is so arranged as to set the temperatures in a region on the side closer to the inlet of the drying oven, i.e. in the region where the temperatures of the coat on the work are gradually elevated, lower than a region on the side remote from the inlet thereof, thereby preventing the coat from elevating rapidly and from causing pinholes.

For example, U.S. Pat. No. 4,919,977 discloses technology that the work is rotated about its longitudinal and lengthwise axis extending nearly horizontally at least during drying the coat on the work in order to prevent the paint of the coat from sagging and flowing downwards and provide the resulting coat with a highly smooth surface.

Recently, there is an increasing tendency that conditions required for coating the work, i.e. automotive vehicle body parts, with the paint be diversified. More particularly, the conditions required for coating the automotive vehicle body parts and so on may include, for example, the difference of paints in kind, e.g. oil-base paints or water-base paints, the number of coats, i.e. a single coat or plural coats put on the surface of the work at one time or at plural times, film thickness of the coat, colors, i.e. a single color or two or more plural colors, requirements for rotating the work about its axis for preventing a sag of the paint coated, and so on.

Even if some of those conditions would be required to be met under these circumstances, only one coating line may not deal with them. In this case, another coating line is required. As the number of those conditions required increases, an increase in the number of coating lines is also required. In addition, even if the coating conditions would be the same, plural coating lines are required from a demand for mass production of the work. It is extremely uneconomical and disadvantageous, however, to provide each of the coating lines with a drying oven individually because such a drying oven is extremely large in size or area and expensive in investment cost.

As it is unavoidable to dispose plural coating lines in order to meet with requirements for diversely different conditions for coating, attempts have been made to solve or improve the problems inherent in the provision with the plural coating lines, as described hereinabove.

SUMMARY OF THE INVENTION

Therefore, the object of the present invention is to provide a coating method and a coating system therefor, so adapted as to simplify the drying oven as a whole to the smallest possible extent and to enjoy high freedom to arrange the coating system as a whole.

In order to achieve the aforesaid object, in one aspect, the present invention consists of a coating method in plural coating lines, each having a coating zone for coating work with a paint and a preparatory drying oven for performing preparatory drying of the coat formed in the coating zone, and a main drying oven so disposed as to be in common with the plural coating lines, comprising:

feeding the work from each of the plural coating lines to the one main drying oven after the preparatory drying; and performing main drying of the coal oil the work.

In another aspect, the present invention consists of a coating system, comprising:

plural coating lines, each comprising a coating zone for coating work with a paint and a preparatory drying oven for performing preparatory drying of a coat formed with the paint on the work in the coating zone;

one main drying oven for performing main drying of the coat on the work;

a drying line so disposed as to pass through the main drying oven; and transfer means disposed on the side downstream of the preparatory drying oven for transferring the work conveyed independently from each of the coating lines to the drying line.

With the arrangement as described hereinabove, the present invention requires only one main drying oven which is necessary for performing a final stage of drying the coat on the work, regardless of the provision of plural coating lines. Hence, it is obviously apparent that the coating system according to the present invention is extremely simpler in structure or layout as a whole and extremely less expensive than the provision of each of the plural coating lines with such a drying oven as arranged for performing a whole series of drying steps.

It is to be noted that, as a considerably large quantity of volatile components of the paint has already been evaporated from the coat on the work when the work had passed through the preparatory drying oven, the work fed from the preparatory drying oven can be heated in the main drying oven to a predetermined temperature without paying any attention to measures and procedures for preventing pinholes. This can help to shorten the length of the time the work is in the main drying oven and save plant investment to a considerable extent. Further, this arrangement can improve productivity as a whole.

It is further to be noted that, as the coat on the work has already been dried preparatorily in the preparatory drying oven disposed on the coating line, the risk of dirt adhering to a surface of the coat is avoidable during conveyance to the main drying oven even if the work is to be conveyed in a considerably long distance to the main drying oven.

When the work is conveyed from one coating line to another to provide the work with plural coats without the transfer to the main drying oven, the coat on the work has already been dried preparatorily to an extent to which no dirt adheres to the surface of the coat on the work due to viscosity of the paint of the coat, the risk of dirt adhering to the surface of the coat can be avoided during travel of the work from one coating line to another. Furthermore, a second coat or subsequent coats can be formed in a good state on the surface of the coat to be located underneath.

As described hereinabove, the coating system according to the present invention can solve the problem with adhesion of dirt to the surface of the coat on the work to be caused during travel of the work to the main drying oven. Further, the coating system according to the present invention requires only one main drying oven even if the plural coating lines are provided. Hence, a high degree of flexibility can be attained in the arrangement of plural preparatory drying ovens and coating lines within a whole layout of the coating system, as compared with the provision of plural main drying ovens and coating lines within the same whole layout of the coating system, because each of the preparatory drying ovens is much smaller in size and area than the main drying oven. This freedom can remarkably be enhanced, for example, by arranging for conveyor means in a lift type to convey the work from each of the coating lines to the drying line for the main drying oven, thereby conveying the work from the drying line to the main drying oven.

Other objects, features and advantages of the present invention will become apparent in the course of the description of the preferred embodiments, which follows, with reference to the accompanying drawings.

DESCRIPTION OF THE PREFERRED EMBODIMENTS

The present invention will be described more in detail in conjunction with the accompanying drawings.

Figure 1:
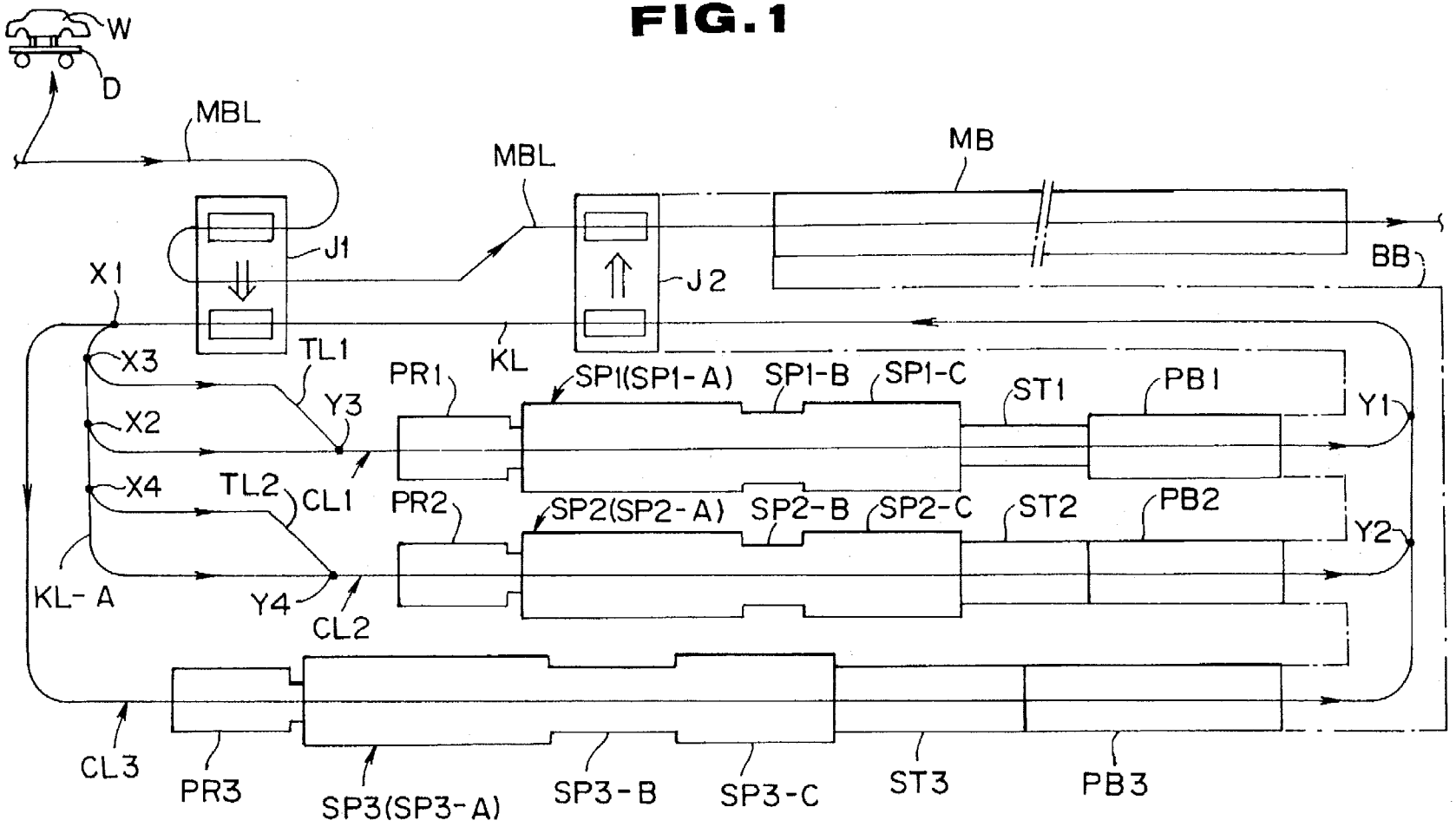
FIG. 1 is a plan view showing a whole layout of the coating system according to an embodiment of the present invention.

As shown in FIG. 1, this embodiment contains three coating lines consisting of a first coating line CL1, a second coating line CL2 and a third coating line CL3, and one main drying oven MB is provided for the three coating lines.

The three coating lines are constructed such that the third coating line CL3 is of an endless type in association with a common line KL and the first coating line CL1 is merged at its downward end with the common line KL at a first merging section Y1 and the second coating line CL2 is merged at its downward end with the common line KL at a second merging section Y2.

The common line KL has a branch line KL-A at its branch section X1. The branch line KL-A is connected to an upward end of the second coating line CL2. The branch line KL-A is further connected to an upward end of the first coating line CL1 at a branch section X2.

The branch line KL-A is divided into a first sub-branch line TL1 at its branch section X3 and a second sub-branch line TL2 at its branch section X4. The other end of the first sub-branch line TL1 is connected to the first coating line CL1 at a merging section Y3 disposed on the upward end portion thereof, and the other end of the second sub-branch line TL2 is connected to the second coating line CL2 at a merging section Y4 disposed on the upward end portion thereof. The sub-branch line TL1 and the sub-branch line TL2 are arranged to temporarily keep the work W, i.e. a carrier conveying the work W.

The first coating line CL1 has a first preparatory zone PR1, a first coating zone SP1, a first setting zone ST1 and a first preparatorily drying zone, i.e. a first preparatory drying oven PB1 disposed between the merging sections Y1 and Y3 from its upward side to its downward side, i.e. from the left side to the right side in this drawing. The first coating zone SP1 comprises a base coat zone SP1-A for spraying the work W with a base coat, a flash-off idle zone SP1-B, and a clear coating zone SP1-C for spraying the work W with a clear coat. In the coating zone SP1, the paint is sprayed by electrodeposition or the like.

Likewise, the second coating line CL2 has a second preparatory zone PR2, a second coating zone SP2, a second setting zone ST2 and a second preparatorily drying zone, i.e. a second preparatory drying oven PB2 disposed between the merging sections Y2 and Y4 from its upward side to its downward side, i.e. from the left side to the right side in this drawing. In the second setting zone ST2, the setting is performed by heating. In other words, this zone is a pre-heating zone. The second coating zone SP2 comprises a base coat zone SP2-A for spraying the work W with a base coat, a flash-off idle zone SP2-B, and a clear coating zone SP2-C for spraying the work W with a clear coat. In the coating zone SP2, the paint is sprayed by electro-deposition or the like.

Further, the third coating line CL3 has a third preparatory zone PR3, a third coating zone SP3, a third setting zone ST3 and a third preparatorily drying zone, i.e. a third preparatory drying oven PB3 disposed from its upward side to its downward side, i.e. from the left side to the right side in this drawing. In the third setting zone ST3, the setting is performed by heating. In other words, this zone is a pre-heating zone. The third coating zone SP3 comprises a base coat zone SP3-A for spraying the work W with a base coat, a flash-off heating zone SP3-B, and a clear coating zone SP3-C for spraying the work W with a clear coat. In the coating zone SP3, the paint is sprayed by electrodeposition or the like.

In the first setting zone ST1 in the first coating line 1, the coat is set at temperatures as low as room temperature. In the second setting zone ST2 in the second coating line 2 and in the third setting zone ST3 in the third coating line 3, the coat is set at temperatures relatively higher than room temperature yet lower than ambient temperatures in the preparatory drying ovens PB2 and PB3. The preparatory drying ovens PB1, PB2 and PB3 as well as the main drying oven MB are each of a type in which far infrared rays are applied or warm wind is blown or two different types are combined. The drying conditions for the main drying oven MB are in common with those for the plural coating lines CL1, CL2 and CL3.

The drying conditions for the preparatory drying ovens PB1, PB2 and PB3 may be set individually and independently from each other so as to cure the coat to a predetermined degree of hardness at the time when the preparatory drying has been finished at the corresponding preparatory drying ovens PB1, PB2 and PB3. In other words, the coat is cured to an extent to which dirt present in the coating system does not adhere to the surface of the coat on the work W due to viscosity of the paint of the coat thereon or to which the surface of the coat is not affected adversely at all by exterior force applied by lightly touching the surface of the coat on the work W by a finger.

In order to completely prevent dirt from adhering to the surface of the coat on the work W during travel from the preparatory drying oven to the main drying oven, a dust-proof booth BB is so disposed as to cover a path ranging from an outlet of each of the preparatory drying ovens PB1, PB2 and PB3 to an inlet of the main drying oven MB.

For the main drying oven MB, there is disposed one drying line MBL which in turn is disposed parallel to the common line KL in a distance extending between the branch section X1 and the merging section Y1. And the drying line MBL and the common line KL are provided with two transfer units J1 and J2. The first transfer unit J1 is disposed in a position closer to the branch section X1, i.e. upward or the preparatory drying ovens PB1, PB2 and PB3, while the second transfer unit J2 is disposed in a position closer to the merging section Y1, i.e. downward of the preparatory drying ovens PB1, PB2 and PB3 yet upward of the main drying oven MB.

The first transfer unit J1 is so disposed as to transfer the work W not yet coated from the drying line MBL to the common line KL for coating the work W with a paint. On the other hand, the second transfer unit J2 is so disposed as to transfer the work W coated and preparatorily dried at each of the preparatory drying ovens PB1, PB2 and PB3 from the common line KL to the main drying oven MB for main drying. It can be noted herein that an upward portion of the drying line MBL is also employed as a supply line for supplying the work W not yet coated to each of the coating lines CL1, CL2 and CL3.

It is to be noted herein that, in this embodiment, the work W is an automotive vehicle body and the work W is loaded on and conveyed by a conveyor carrier D. More specifically, the work W is conveyed by the conveyor carrier D on the drying line MBL up to the first transfer unit J1 at the branch section X1 and transferred to the common line KL by the first transfer unit J1. Each piece of the work W transferred to the common line KL, is then distributed to one of the predetermined coating lines CL1, CL2 and CL3 according to the predetermined coating conditions.

After it has been coated and preparatorily dried in the corresponding preparatory drying oven PB1, PB2 or PB3, the work W is conveyed through the respective coating line CL1, CL2 or CL3 and then through the common line KL to the second transfer unit J2 that transfers the work W to the drying line MBL for performing main drying, i.e. baking, the work W in the main drying oven MB.

In this embodiment, the first and second coating lines CL1 and CL2 are set for coating the work W with an oil-base paint, while the third coating line CL3 is set for coating it with a water-base paint. The following is description on the coating conditions for each of the coating lines CL1, CL2 and CL3 by way of examples.

In the coating zone SP1-A of the first coating line CL1, the work W may be sprayed with oil-base paint such as an acrylic paint, a melamine paint or a melamine alkyd paint, which may function as a base coat, a clear coat or a solid coat and which may be cured at 140° C. for 20 minutes to a predetermined degree of hardness. The setting zone ST1 of the first coating line CL1 may have the coat on the work W set at room temperature for 8 minutes. After it has been set in the first setting zone ST1 at room temperature, the work W is then conveyed to the preparatory drying oven PB1 where it may be dried at 130° C. for 10 minutes or at 140° C. for 5 minutes.

Like in the coating zone SP1-A of the first coating zone CL1, in the coating zone SP2-A of the second coating line CL2, the work W may be sprayed with oil-base paint such as an acrylic paint, a melamine paint or a melamine alkyd paint, which may function as a base coat, a clear coat or a solid coat and which may be cured at 140° C. for 20 minutes to a predetermined degree of hardness. The setting zone ST2 of the second coating line CL2 may have the coat on the work W set for 8 minutes at temperature as high as 80° C. to 100° C. After it has been set in the second setting zone ST2, the work W is then conveyed to the preparatory drying oven PB2 where it may be dried at 130° C. for 10 minutes or at 140° C. for 5 minutes.

It can be noted herein that the second coating line CL2 is to pre-heat the coat on the work W prior to entering the preparatory drying oven PB2 so that the setting zone is set at the temperature considerably higher than the setting temperature set for the setting zone ST1 of the first coating line CL1, i.e. room temperature as high as, for example, 20° C. The coating conditions for the second coating line CL2 are chosen depending upon the kind of the oil-base paint, thereby providing the coat on the work W with a highly smooth surface.

In the coating zone SP3-A of the third coating line CL3, the work W may be sprayed with water-base paint such as an acrylic paint, a melamine paint or a melamine alkyd paint, which may function as a base coat, a clear coat or a solid coat and which may be cured at 140° C. for 30 minutes to a predetermined degree of hardness. The setting zone ST3 of the third coating line CL3 may have the coat on the work W set first at 50° C. for 5 minutes and then at 100° C. for 5 minutes. After it has been set in the third setting zone ST3, the work W is then conveyed to the preparatory drying oven PB3 where it may be dried at 140° C. for 15 minutes.

It is to be noted that in the third setting zone ST3 of the third coating line CL3, the setting temperature in the initial stage may be set to be as relatively low as 50° C. so as to allow low boiling point components (such as water) contained in the coat to evaporate gradually. Then, the setting temperature in the later stage may be set to be as high as 100° C. so as to cause water contained in the coat to evaporate to a satisfactory extent. In this case, the temperature for preparatorily drying the work W in the third coating line CL3 can be set to the same as the temperature in the main drying oven MB, in order to cope with water-base paint of such a type as curable for a longer period of time. With the arrangement for the coating and drying conditions, it is possible to sufficiently prevent pinholes from occurring.

In this embodiment, the temperature within the main drying oven MB is set at 140° C. and the work W is baked at that temperature for 15 minutes.

It is further noted that in the first, second and third coating lines CL1, CL2 and CL3, a base coat may be formed on a clear coat or a clear coat may conversely be formed on a base coat, particularly when a metallic coat is formed. A solid coat may be formed on another solid coat by spraying a paint of a solid coat type at plural times.

The coating lines CL1, CL2 and CL3, as shown in FIG. 1, may be arranged to form only an intermediate coat or a top coat or some of them are arranged to form an intermediate coat while the rest to form a top coat. The arrangement for the coating lines CL1, CL2 and CL3 may be determined in accordance with the coating conditions for the work W. This can be said true of the embodiments which follow, unless otherwise specified.

The coating lines CL1, CL2 and CL3 may be set so as to correspond to another example of the coating and drying conditions as will be described hereinafter.

In this embodiment, too, the first and second coating lines CL1 and CL2 are set for coating the work W with an oil-base paint, while the third coating line CL3 is set for coating it with a water-base paint. The following is description on the coating conditions for each of the coating lines CL1, CL2 and CL3 by way of examples.

In the coating zone SP1-A of the first coating line CL1, the work W may be sprayed with oil-base paint such as an acrylic paint, a melamine paint or a melamine alkyd paint, which may function as a base coat, a clear coat or a solid coat and which may be cured at 140° C. for 20 minutes or at 150° C. for 15 minutes to a given degree of hardness. The setting zone ST1 of the first coating line CL1 may have the coat on the work W set at room temperature for 8 minutes. After it has been set in the first setting zone ST1 at room temperature, the work W is then conveyed to the preparatory drying oven PB1 where it may be dried at 130° C. for 10 minutes or at 140° C. for 5 minutes.

Like in the coating zone SP1-A of the first coating zone CL1, in the coating zone SP2-A of the second coating line CL2, the work W may be sprayed with oil-base paint such as an acrylic paint, a melamine paint or a melamine alkyd paint, which may function as a base coat, a clear coal or a solid coat and which may be cured at 150° C. for 20 minutes to a given degree of hardness. The setting zone ST2 of the second coating line CL2 may have the coat on the work W set for 8 minutes at temperature as high as 80° C. to 100° C. After it has been set in the second setting zone ST2, the work W is then conveyed to the preparatory drying oven PB2 where it may be dried at 140° C. for 10 minutes or at 150° C. for 7 minutes.

It can be noted herein that the second coating line CL2 is to pre-heat the coat on the work W prior to entering the preparatory drying oven PB2 so that the setting temperature is set to be considerably higher than the setting temperature set for the setting zone ST1 of the first coating line CL1, i.e. room temperature as high as, for example, 20° C. The coating conditions for the second coating line CL2 are chosen depending upon the kind of the oil-base paint, thereby providing the coat on the work W with a highly smooth surface, like in the first embodiment as described hereinabove. Further, the second coating line CL2 is disposed to cope with oil-base paint which can be cured at higher temperature.

In the coating zone SP3-A of the third coating line CL3, the work W may be sprayed with water-base paint such as an acrylic paint, a melamine paint or a melamine alkyd paint, which may function as a base coat, a clear coat or a solid coat and which may be cured at 140° C. for 30 minutes or at 150° C. for 20 minutes to a predetermined degree of hardness. The setting zone ST3 of the third coating line CL3 may have the coat on the work W set first at 50° C. for 5 minutes and then at 100° C. for 5 minutes. After it has been set in the third setting zone ST3, the work W is then conveyed to the preparatory drying oven PB3 where it may be dried at 140° C. for 10 minutes or at 150° C. for 7 minutes.

It is to be noted in the first embodiment as described hereinabove that in the third setting zone ST3 of the third coating line CL3, the setting temperature in the initial stage may be set to be as relatively low as 50° C. so as to allow low boiling point components (such as water) contained in the coat to evaporate gradually. Then, the setting temperature in the later stage may be set to be as high as 100° C. so as to cause water contained in the coat to evaporate to a satisfactory extent. In this case, the temperature for preparatorily drying the work W in the third coating line CL3 can be set to the same as the temperature in the main drying oven MB, in order to deal with water-base paint of such a type as curable at high temperature. With the arrangement for the coating and drying conditions, it is possible to sufficiently prevent pinholes from occurring.

In this embodiment, the temperature within the main drying oven MB is set at 150° C. and the work W is baked at that temperature for 13 minutes.

Figure 4:
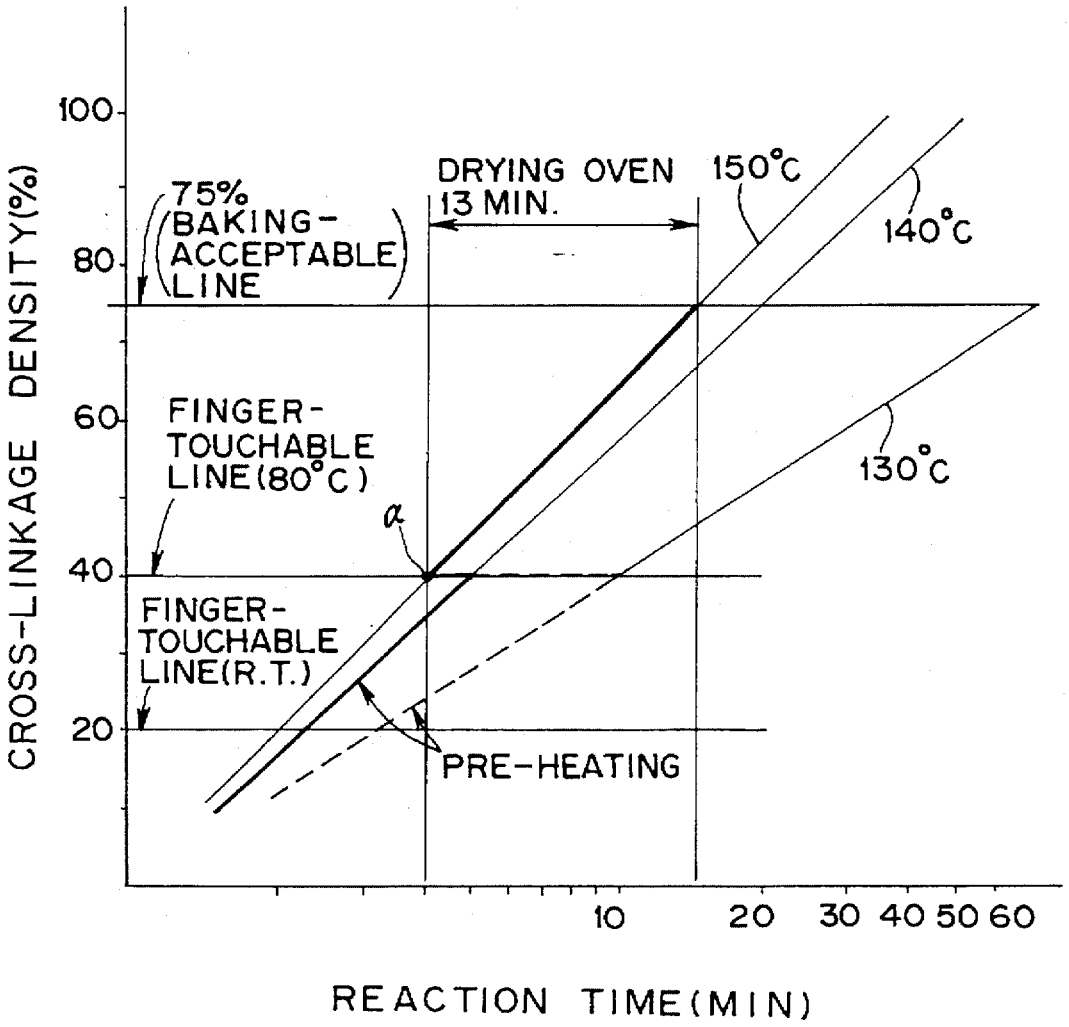
FIG. 4 is a time chart showing a relationship between the cross-linkage density and the reaction time when a paint is cured at 140° C. for 20 minutes.

FIG. 4 is a graph showing a model in which the work W is sprayed with oil-base paint and the coat sprayed on the work W is cured in the first coating line CL1. The oil-base paint coated thereon is of such a type as requiring the resulting coat to be heated at 140° C. for 20 minutes in order to attain 75% of its full cross-linkage density.

As shown in FIG. 4, a degree of the cross-linkage density of the paint in the coat on the work W reaches 40% when it is cured in the preparatory drying oven PB1 by preparatorily drying it at 130° C. for 10 minutes. As the cross-linkage density of the paint in the coat has reached 40%, the surface of the coat said to be cured to such an extent to which it is not adversely affected even if it would be touched lightly by a finger. Hence, it can be readily understood that the coal is further required to be baked in the main drying oven MB at 150° C. for another 13 minutes from time $\alpha$ in order to attain 75% of its full cross-linkage density.

Further, it is to be understood from the results shown in FIG. 4 that the heating at 140° C. for 5 minutes can gain 40% of full cross-linkage density of the paint, whereas the baking additionally for approximately 20 minutes is required to reach 75%.

Figure 5:
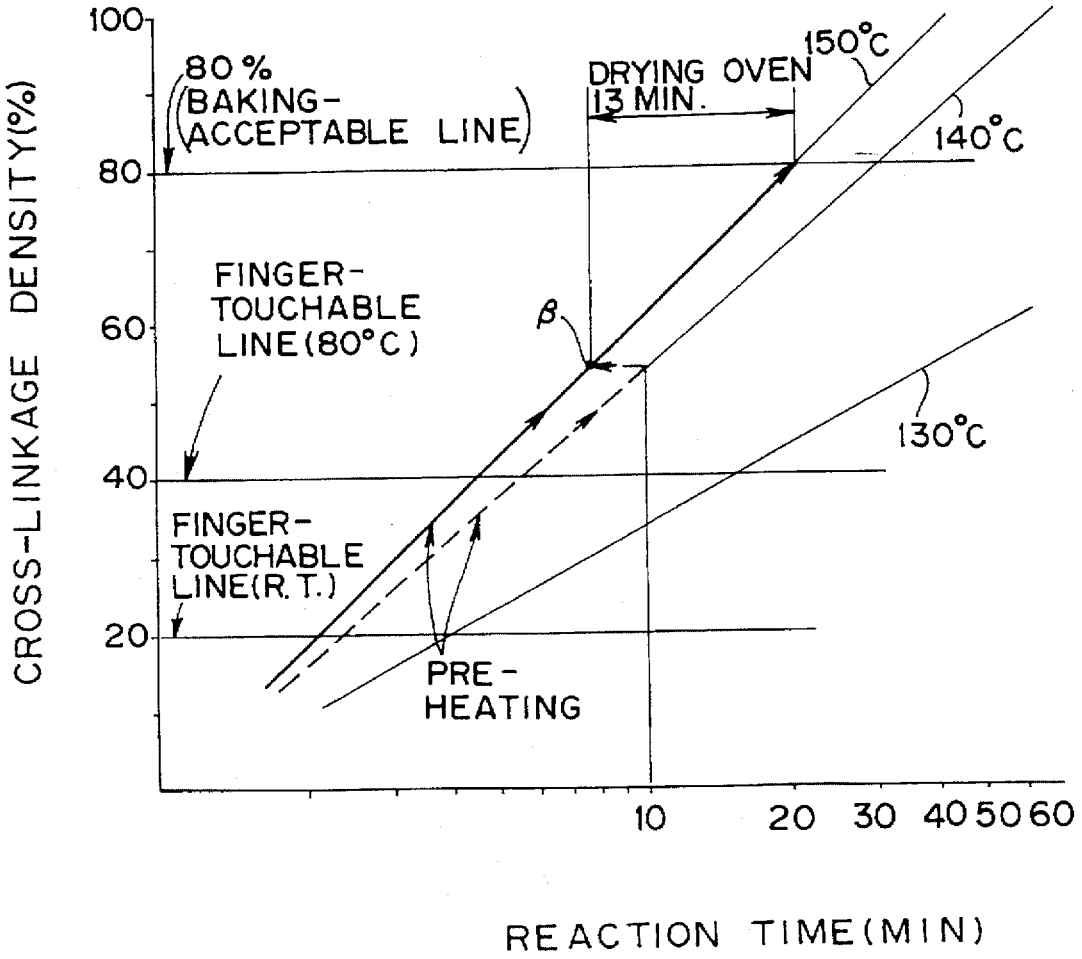
FIG. 5 is a time chart showing a relationship between the cross-linkage density and the reaction time when a paint is cured at 150° C. for 20 minutes.

FIG. 5 is a graph showing a model in which the work W is sprayed with water-base paint and the coat sprayed on the work W is cured in the third coating line CL3. The water-base paint coated thereon is of such a type as requiring the resulting coat to be heated at 150° C. for 20 minutes in order to attain 80% of its full cross-linkage density. It is noted herein that what is meant by FIG. 5 is the same as by FIG. 4, so that duplicate description will be omitted from this specification for brevity of explanation.

Figure 2:
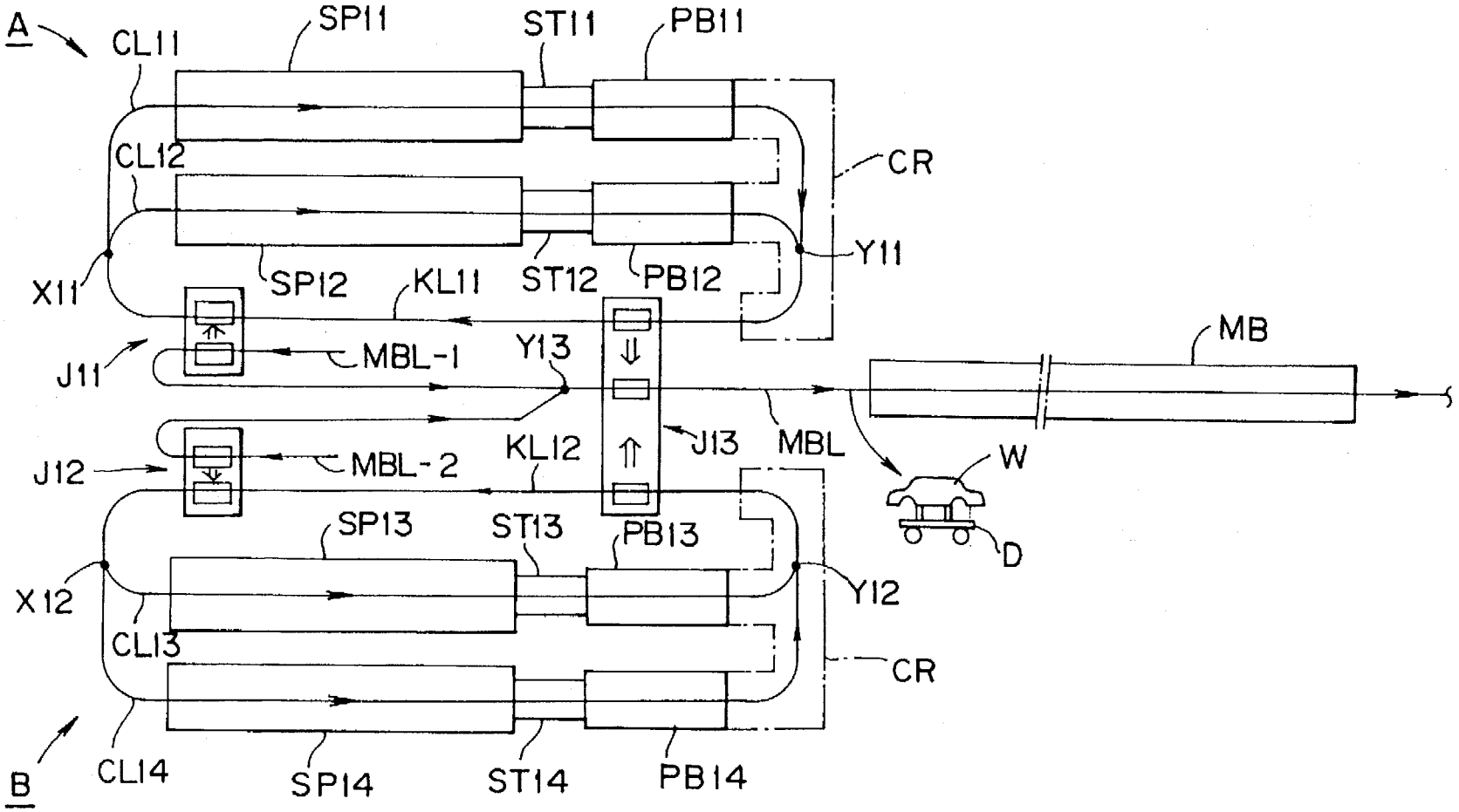
FIG. 2 is a plan view showing a whole layout of the coating system according to another embodiment of the present invention.

FIG. 2 is directed to another embodiment of the coating system according to the present invention. In this embodiment, a first coating region A has a first coating line CL11 and a second coating line CL12, while a second coating region B has a third coating line CL13 and a fourth coating line CL14. As shown in FIG. 2, reference symbol MB denotes a main drying oven and reference symbol MBL denotes a drying line. Reference symbol SP11 denotes a first coating zone and reference symbol SP12 denotes a second coating zone for the first coating region A, while reference symbols SP13 and SP14 denote third and fourth coating zones for the second coating region B, respectively. Reference symbol ST11 denotes a first setting zone for the first coating line CL11 and reference symbol ST12 stands for a second setting zone for the second coating line CL12 in the first coating region A. On the other hand, reference symbols ST13 and ST14 stand for a third setting zone and a fourth setting zone for the third and fourth coating lines CL13 and CL14 in the second coating region B, respectively. Further, reference symbol PB11 stands for a first preparatory drying oven for the first coating line CL11 and reference symbol PB12 for a second preparatory drying oven for the second coating line CL12 in the first coating region A, while reference symbol PB13 stands for a third preparatory drying oven for the third coating line CL13 and reference symbol PB14 for a fourth preparatory drying oven for the fourth coating line CL14 in the second coating region B. Reference symbols KL11 and KL,12 denote common lines, while reference symbols X11 and X12 denote branch sections and reference symbols Y11, Y12 and Y13 denote merging sections. Further, reference symbols J11, J12 and J13 denote first, second and third transfer units, respectively.

In this embodiment, the first and second coating lines CL11 and CL12 in the first coating region A are set for coating the work W with an intermediate paint, while the third and fourth coating lines CL13 and CL14 in the second coating region B are set for coating the work W with a top coat.

As shown in FIG. 2, the drying line MBL is formed by merging a first supply line MBL-1 and a second supply line MBL-2 at the merging section Y13. The first transfer unit J11 1s arranged so as to bridge between the first common line KL11 and the first supply line MBL-1, while the second transfer unit J12 is arranged so as to bridge between the second common line KL,12 and the second supply line MBL-2. Further, the third transfer unit J13 is so constructed as to bridge between the first common line KL11 and the drying line MBL and between the second common line KL12 and the drying line MBL. With the arrangement as described hereinabove, the work W is conveyed through the first supply line MBL-1 after it has been coated with a base paint or an under coat and it is then transferred to the common line KL11 in the first coating region A by the first transfer unit J11. The work W is then conveyed through the first common line KL11 through the branch section X11 to either of the first coating line CL11 or the second coating line CL12. In either of the first or second coating line CL11 or CL12, the work W is coated with an appropriate paint in the corresponding coating zone SP11 or SP12 and the coat on the work W is then set in the corresponding setting zone ST11 or ST12, followed by passage through the respective preparatory drying oven PB11 or PB12 and by conveyance through the merging section Y11 and then through the first common line KL11 to the third transfer unit J13. Then, the work W is transferred to the drying line MBL by the third transfer unit J13 for subjecting the work W to main drying. i.e. baking it, in the main drying oven MB.

After it has been coated with the intermediate paint in the first coating region A, then the work W is conveyed to the second coating region B for forming a top coat. As shown in FIG. 2, the work W is conveyed through the second supply line MBL-2 and transferred to the second common line KL12 in the second coating region B by the second transfer unit J12. The work W is then distributed at the branch section X12 to either of the third coating line CL13 or the fourth coating line CL14 in accordance with the coating conditions required. The work W is sprayed with the predetermined top paint in the respective coating zone SP13 or SP14 and then set in the corresponding setting zone ST13 or ST14, followed by passage through the third preparatory drying oven PB13 or the fourth preparatory drying oven PB14. After it has been preparatorily dried in the corresponding preparatory drying oven PB13 or PB14, the work W is withdrawn from the preparatory drying oven PB13 or PB14 and conveyed through the merging section Y12 and the second common line KL12 to the third transfer unit J13 which in turn transfers the work W to the drying line MBL for subjecting it to main drying, i.e. baking it, in the common main drying oven MB.

It is to be noted herein that both of the distance of the first common line KL11 between the first transfer unit J11 and the first branch section X11 in the first coating region A and the distance of the first common line KL12 between the second transfer unit J12 and the second branch section X12 in the second coating region B serve as awaiting the conveyor carrier D with the work W loaded thereon for entry into the predetermined coating line.

The coating conditions applicable to the arrangement for the coating system as shown in FIG. 2 may be described in the following way. In this embodiment, as described hereinabove, the first and second coating lines CL11 and CL12 in the first coating region A are set for coating the work W with an intermediate paint, while the third and fourth coating lines CL13 and CL14 in the second coating region B are set for coating it with a top paint.

In this embodiment, the intermediate paint to be employed for the first and second coating zones SP11 and SP12 in the first coating region A may be of a polyester-melamine type. The intermediate paint may be cured to a predetermined degree of cross-linkage density or hardness by healing the resulting coal at 140° C. for 20 minutes. On the other hand, the top paint to be employed for the third and fourth coating zones SP13 and SP14 in the second coating region B may be of an acryl-melamine type or of a melamine-alkyd type and further of a base coat type, of a clear coat type or of a solid coat type. This top paint may be cured to a predetermined degree of cross-linkage density or hardness by heating the paint in the resulting coat on the work W at 140° C. for 20 minutes.

The intermediate coat formed on the work W in the corresponding coating zone SP11 or SP12 is then conveyed and set or cured to a predetermined degree of cross-linkage density at room temperature for 8 minutes in the respective setting zone ST11 or ST12, followed by conveyance to the corresponding preparatory drying oven PB11 or PB12, each of which is so set as to preparatorily dry the work W by heating at 130° C. for 10 minutes or at 140° C. for 5 minutes. Likewise, the top coat formed on the work W in the coating zone SP13 or SP14 is then set and cured in the same conditions in the respective setting zone ST13 or ST14 as in the setting zone ST11 or ST12 for the intermediate coat, followed by preparatorily coating in the respective preparatory drying oven PB13 or PB14 in the same conditions as in the first and second preparatory drying ovens PB11 and PB12 in the first coating region A for the intermediate coat.

The coat on the work W is then conveyed and baked in the main drying oven MB at 140° C. for 15 minutes.

In the embodiment as shown in FIG. 2, the first coating region A may be arranged to coat the work W with top paints in two colors. In this case, the third coating line CL13 in the second coating region B may be set for forming a top coat in a single color, while the fourth coating line CL14 may be set for spraying the work W with top coats in two colors or with another top coat over a top coat which has been already formed.

Figure 3:
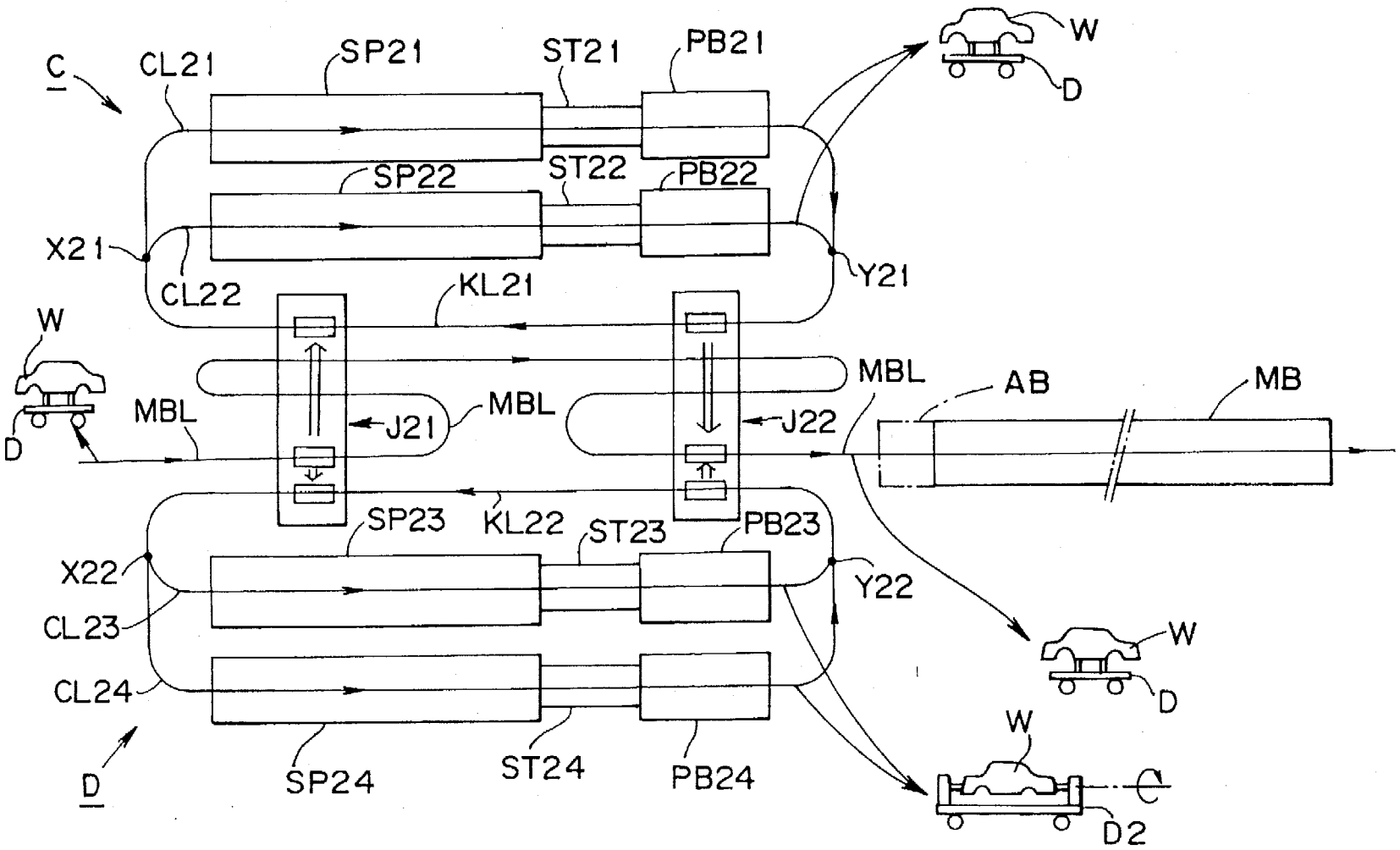
FIG. 3 is a plan view showing a whole layout of the coating system according to a further embodiment of the present invention.

FIG. 3 is directed to a further embodiment of the coating system according to the present invention. In this embodiment, a coating region C is provided with two coating lines, i.e. a first coating line CL21 and a second coating line CL22, while a coating region D is provided with two coating lines, i.e. a third coating line CL23 and a fourth coating line CL24.

As shown in FIG. 3, reference symbol MB denotes a main drying oven and reference symbol MBL denotes a drying line that is also employed as a supply line for supplying the work W to a common line. The first coating line CL21 has a first coating zone SP21, a first setting zone ST21 and a first preparatory drying oven PB21, while the second coating line CL22 has a second coating zone SP22, a second setting zone ST22 and a second preparatory drying oven PB22. The coating region C is provided with a first common line KL21 which in turn branches at a branch section X21 into the first coating line CL21 and the second coating line CL22, and the first and second coating lines CL21 and CL22 are merged at a merging section Y21 into the common line KL21. Likewise, the third coating line CL23 has a third coating zone SP23, a third setting zone ST23 and a third preparatory drying oven PB23, while the fourth coating line CL24 has a fourth coating zone SP24, a fourth setting zone ST24 and a fourth preparatory drying oven PB24. The coating region D is provided with a second common line KL22 which in turn branches at a branch section X22 into the third coating line CL23 and the fourth coating line CL24, and the third and fourth coating lines CL23 and CL24 are combined or merged at a merging section Y22 into the single common line KL22.

Referring further to FIG. 3, the work W is conveyed by the carrier D through the supply line MBL to a first transfer unit J21 which transfers the work W to a conveyor carrier D stayed in the first common line KL21 or to a conveyor carrier D2 stayed in the second common line KL22 in accordance with the coating conditions required. The work W delivered to the first common line KL21 is then conveyed to either one of the first or second coating line CL21 or CL22 and discharged from the respective preparatory drying oven PB21 or PB22 through the respective coating line CL21 or CL22, followed by passage through the merging section Y21 and by conveyance through the first common line KL21 to the second transfer unit J22 by which the work W is transferred to the drying line MBL. Likewise, the work W delivered to the second common line KL22 is conveyed through the common line KL22, distributed to and conveyed through either of the third or fourth coating line CL23 or CL24, and further conveyed through the common line KL22, again, to the second transfer unit J22 which in turn transfers the work W on a conveyor carrier D2 to another conveyor carrier D on the drying line MBL for conveying it to the main drying oven MB for main drying, i.e. baking.

In this embodiment as shown in FIG. 3, all the coating lines CL21, CL22, CL23 and CL24 are set to coat the work W with a top coat or top coats. It can be noted herein that the first and second coating lines CL21 and CL22 in the coating region C are arranged to preparatorily dry a coat formed on a surface of the work W in conventional manner which does not particularly require it to rotate on the conveyor carrier D2.

More specifically, the work W is sprayed in the first or second coating zone SP21 or SP22 in the respective coating line CL21 or CL22 with a top paint on at least its surface extending upwards or downwards in such a film thickness as exceeding a sagging limit thickness and as causing a sag due to heat flow and flowing downwards due to gravity in the respective preparatory drying oven PB21 or PB22 if the coat formed on the surface would be left untreated as it has been sprayed and unrotated.

On the other hand, the third and fourth coating lines CL23 and CL24 in the coating region D are so arranged as to rotate the work W on the conveyer carrier D2 about its longitudinal or lengthwise axis extending nearly horizontally in the respective preparatory drying oven PB23 or PB24, in order to prevent the paint in the coat from sagging. The velocity of rotation of the work W is fast enough to prevent the paint from sagging due to gravity yet slow enough to cause no sagging due to centrifugal force of rotation.

By preparatorily drying the coat on the work W in the preparatory drying ovens PB23 and PB24 while rotating the work W in the manner as described hereinabove, the coat of the work W is cured to such a degree of hardness as causing no sagging and no flowing downwards any more due to gravity when the work W has been discharged from either of the preparatory drying oven PB23 or PB24.

As the work W is rotated in the third and fourth preparatory drying ovens PB23 and PB24, the carrier D2 to be employed in the coating region D is a conveyor carrier which has a rotating mechanism for rotating the work W about its longitudinal or lengthwise axis extending nearly horizontally. On the other hand, the conveyor carrier to be employed for the first and second coating lines CL21 and CL22 in the coating region C where conventional coating is performed may be the same one as employed for the supply line or drying line MBL, i.e. conveyor carriers of a conventional type having no mechanism for rotating the work W.

It is to be noted herein that the rotating mechanism and procedures are described in detail in U.S. Pat. No. 4,919,977.

The coating and drying conditions for the coating system according to the present invention may be described in the following way.

In other words, a paint to be employed for the coating region C may be of an acrylic-melamine type or of a melamine-alkyd type and further of a base coat type, of a clear coat type or of a solid coat type. The paint may be cured to a predetermined degree of cross-linkage density or hardness by heating it at 140° C. for 20 minutes. The work W is coated with such a paint in each of the coating zones CL21 and CL22 to a film thickness to which the paint of the coat does not cause sagging and flowing downwards during preparatorily drying and during main drying, i.e. baking, without rotating the work W. The coat formed on the work W is then conveyed to the corresponding setting zones ST21 and ST22 where the coat is set at room temperature for 8 minutes, followed by passage through the corresponding preparatory drying ovens PB21 and PB22 where the coat is heated at 130° C. for 10 minutes or at 140° C. for 5 minutes. The work W is then transferred by the transfer unit J22 from the coating region C to the drying line MBL for baking it in the main drying oven MB where the baking is performed by heating it at temperature as high as 140° C. for 15 minutes.

On the other hand, a paint to be employed for the coating region D may be the same as that employed for the coating region C. It is to be noted herein that the work W is coated in the coating zones SP23 and SP24 with the paint in such a film thickness that exceeds its sagging limit thickness, i.e. a film thickness in which the paint coated on the work W may cause sagging due to heat flow and flow downwards due to gravity unless it is so rotated as to cause the paint any sag or downward flow. The work W coated in a so thick way is then set in the setting zones ST23 and ST24 and dried in the preparatory drying ovens PB23 and PB24 in the same manner as in the coating region C, except for rotation or the work W on the carrier D2 during travel of the preparatory drying ovens PB23 and PB24. The work W so dried is then conveyed to the second transfer unit J22 and transferred to the drying line MBL by the second transfer unit J22 for baking the work W in the main drying oven MB. It is to be noted that the work W may be rotated in the same manner as described hereinabove, as required or needed, in the setting zones ST23 and ST24.

in the embodiment, the drying and, as needed, the setting of the intermediate coat may be performed by rotating the work W as well as the drying and, as needed, the setting of the top coat may be performed by rotating it in the manner as described hereinabove.

A dust-proof booth may also be disposed in the coating system according to the present invention as shown in FIGS. 2 and 3. Further, referring to FIGS. 1, 2 and 3, a cooling chamber may be disposed in a position on the outlet side of the preparatory drying ovens PB1 to PB3, PB11 to PB14 and PB21 to PB24. As shown in FIG. 2, a cooling chamber CR is indicated by dot-dash line. Referring to FIGS. 1 to 3, an air blowing chamber may be disposed in a position on the inlet side of the main drying oven MB. Referring to FIG. 3, an air blowing chamber AB is indicated by the dot-dash line.

In a further embodiment for operating the coating system according to the present invention, the work W may be conveyed to a different coating line without being transferred to the main drying oven MB after it has once been preparatorily dried in another coating line, and the work W is transferred to the main drying oven MB for the first time after it has been dried preparatorily twice or at plural times. In other words, as shown in FIG. 2, when two top coats in different colors are formed using the coating lines CL13 and CL14 in the second coating region B, the work W is first sprayed with one top coat in the coating zone SP13 and the top coat is then set in the setting zone ST13 and dried in the preparatory drying oven PB13, followed by conveyance through the merging section Y12 and the common line KL12 to the branch line X12, without transfer by the third transfer unit J13. The work W is further conveyed to the coating zone SP14 where the second paint is coated on the first coat of the work W and the coat is then set in the setting zone ST14 and dried in the preparatory drying oven PB14, followed by conveyance to the third transfer unit J13 through the merging section Y12 and the common line KL12 and by transfer of the work W to the main drying oven MB by the third transfer unit J13.

It can further be noted that the number of coating lines to be passed through without transfer to the main drying oven MB is not restricted to two, as described hereinabove, and to three or more and that the work W can be transferred from one coating line to another by a different system, for example, by using a transfer unit or a hanger-type system. Furthermore, it can be noted that, as no special operation for the work W is required in the main drying oven MB, a pitch for conveying the work W in the main drying oven MB can be set shorter than that for conveying it in the coating lines.

It is to be understood that the present invention is not restricted to those described herein-above as illustrative, not as restrictive, and the invention should be interpreted to encompass modifications and variations within the spirit and scope of the present invention.

What is claimed is:

1. A coating method for coating automotive vehicle body pieces in plural coating lines, each of the plural coating lines having a coating zone wherein the automotive vehicle body pieces are coated with a paint and a preparatory drying oven wherein preparatory drying of the coat formed on the automotive vehicle body pieces in the coating zone is performed, the plural coating lines being followed by a single main drying oven so disposed as to be in common with and separate from the plural coating lines, further comprising the steps of:

feeding the automotive vehicle body pieces from each of the plural coating lines to the single main drying oven after the preparatory drying; and performing the main drying of the coat on the automotive vehicle body pieces in the single main drying oven;

wherein each automotive vehicle body piece passes through at least two coating lines of the plural coating lines in order prior to being fed to the main drying oven; and each automotive vehicle body piece is transferred to the main drying oven for main drying after it has passed through the preparatory drying oven in the last of the plural coating lines in which each said automotive vehicle body piece is coated.

2. A coating method as claimed in claim 1, wherein the step of feeding the automotive vehicle body pieces is carried out by transferring the automotive vehicle body pieces to a drying line connected to the main drying oven and disposed independently from the plural coating lines;

wherein one of the plural coating lines is a coating line which operates a conveyor carrier having a mechanism for rotating the automotive vehicle body pieces about their longitudinal or lengthwise axes extending in an approximately horizontal direction; and another of the plural coating lines is a coating line which operates a conveyor carrier having no mechanism for rotating the automotive vehicle body pieces.

3. A coating method as claimed in claim 1, wherein a coat on the automotive vehicle body piece is dried to such an extent that dirt does not adhere to a surface of the coat thereon, after the automotive vehicle body piece has passed through the preparatory drying oven.

4. A coating method as claimed in claim 3, wherein the paint of the coat is dried and cured up to approximately 40% of its full cross-linkage density when the automotive vehicle body piece with the coat formed thereon has passed through the preparatory drying oven.

5. A coating method as claimed in claim 1, wherein the temperature in the preparatory drying oven is set to be lower than temperature in the main drying oven.

6. A coating method as claimed in claim 1, wherein the temperature in the preparatory drying oven is set to be identical to temperature in the main drying oven.

7. A coating method as claimed in claim 1, wherein:

one of the plural coating lines is set for coating the automotive vehicle body pieces with an oil-base paint; and the other of the plural coating lines is set for coating the automotive vehicle body pieces with a water-base paint.

8. A coating method as claimed in claim 1, wherein:

one of the plural coating lines is set for providing the automotive vehicle body pieces with an intermediate coat; and the other of the plural coating lines is set for providing the automotive vehicle body pieces with a top coat.

9. A coating method for coating automotive vehicle body pieces in plural coating lines, each of the plural coating lines having a coating zone wherein the automotive vehicle body pieces are coated with a paint and a preparatory drying oven wherein preparatory drying of the coat formed on the automotive vehicle body pieces in the coating zone is performed, the plural coating lines being followed by a single main drying oven so disposed as to be in common with and separate from the plural coating lines, further comprising the steps of:

preheating the automotive vehicle body pieces to a temperature lower than an ambient temperature in the preparatory drying oven at a point located between the coating zone and the preparatory drying oven in at least one of the plural coating lines;

feeding the automotive vehicle body pieces from each of the plural coating lines to the single main drying oven after the preparatory drying; and performing the main drying of the coat on the automotive vehicle body pieces in the single main drying oven.

10. A coating method for coating automotive vehicle body pieces in plural coating lines, each of the plural coating lines comprising a coating zone wherein the automotive vehicle body pieces are coated with a paint and first and second preparatory drying ovens wherein preparatory drying of the coat formed on the automotive vehicle body pieces in the coating zone is performed, the plural coating lines and plural first and second preparatory drying ovens being followed by a single main drying oven so disposed as to be in common with and separate from the plural coating lines, further comprising the steps of:

feeding the automotive vehicle body pieces from each of the plural coating lines to the single main drying oven after the preparatory drying; and performing the main drying of the coat on the automotive vehicle body pieces in the single main drying oven;

wherein each automotive vehicle body piece passes through at least two coating lines of the plural coating lines in order prior to being fed to the main drying oven; and each automotive vehicle body piece is transferred to the main drying oven for main drying after it has passed through the preparatory drying oven in the last of the plural coating lines in which each said automotive vehicle body piece is coated, wherein either ambient temperature or duration of drying time conditions for the preparatory drying of the automotive vehicle body pieces in the first preparatory drying oven are different from either ambient temperature or duration of drying time conditions for the preparatory drying of the automotive vehicle body pieces in the second preparatory drying oven.

* * * * *